US007306300B2

(12) United States Patent
Kish et al.

(10) Patent No.: US 7,306,300 B2
(45) Date of Patent: Dec. 11, 2007

(54) CABINET RUNNER SIDE WALL EXTENSION

(75) Inventors: Gary R. Kish, Parma, OH (US); Bernard J. Golias, Sr., Hinckley, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 345 days.

(21) Appl. No.: 10/812,225

(22) Filed: Mar. 29, 2004

(65) Prior Publication Data

US 2004/0263033 A1 Dec. 30, 2004

Related U.S. Application Data

(60) Provisional application No. 60/458,633, filed on Mar. 28, 2003.

(51) Int. Cl.
*A47B 88/00* (2006.01)

(52) U.S. Cl. ..... 312/334.1; 312/334.7

(58) Field of Classification Search ..... 312/330.1, 312/334.7, 334.1, 334.5, 334.6, 334.35, 348.1, 312/334.12, 334.18, 334.39, 334.43, 334.27, 312/257.1

See application file for complete search history.

(56) References Cited

U.S. PATENT DOCUMENTS

| | | | | |
|---|---|---|---|---|
| 1,523,653 | A | 1/1925 | Larson et al. | |
| 1,910,208 | A * | 5/1933 | Gronberg et al. | 384/19 |
| 2,273,918 | A * | 2/1942 | Zalkind | 312/261 |
| 2,293,210 | A * | 8/1942 | Marzolf | 312/334.19 |
| 3,389,949 | A | 6/1968 | Studinski et al. | |
| 3,572,874 | A | 3/1971 | Hassel | |
| 3,771,849 | A * | 11/1973 | Barber | 312/350 |
| 4,067,632 | A | 1/1978 | Sekerich | |
| 4,070,076 | A | 1/1978 | Zwillinger | |
| 4,552,415 | A * | 11/1985 | Fulterer | 384/19 |
| 4,681,381 | A | 7/1987 | Sevey | |
| 4,842,351 | A * | 6/1989 | Rock et al. | 312/263 |
| 4,919,548 | A * | 4/1990 | Lautenschlager | 384/19 |
| 5,405,196 | A | 4/1995 | Shoup et al. | |
| 5,470,143 | A | 11/1995 | Gill | |
| 5,470,144 | A * | 11/1995 | Wen | 312/334.13 |
| 5,520,452 | A * | 5/1996 | Petersen et al. | 312/334.12 |
| 5,556,182 | A | 9/1996 | Lai | |
| 5,709,444 | A * | 1/1998 | Fitz et al. | 312/348.2 |
| 5,785,401 | A | 7/1998 | Bowyer et al. | |
| 5,890,784 | A * | 4/1999 | Domig | 312/334.4 |
| 5,906,422 | A * | 5/1999 | Golias, Sr. | 312/334.7 |
| 5,927,839 | A * | 7/1999 | Alfaro | 312/301 |
| 6,076,908 | A | 6/2000 | Maffeo | |
| 7,014,155 | B1 * | 3/2006 | Schnabel et al. | 248/224.8 |
| 2002/0084734 | A1 * | 7/2002 | Shih | 312/334.4 |

* cited by examiner

*Primary Examiner*—Janet M. Wilkens
*Assistant Examiner*—Timothy M Ayres
(74) *Attorney, Agent, or Firm*—Fay Sharpe LLP

(57) ABSTRACT

A cabinet runner side wall extension includes a wall with opposite sides, a flange extending from the wall, and a tab extending from the wall. The flange extends substantially normal from one side of the wall. The tab includes a first portion extending away from a second opposite side of the wall and a second portion spaced from and approximately parallel to the wall.

15 Claims, 2 Drawing Sheets

CABINET RUNNER SIDE WALL EXTENSION

This application claims the benefit of U.S. Provisional Patent Application No. 60/458,633, filed Mar. 28, 2003, which is incorporated by reference herein.

BACKGROUND OF THE INVENTION

This invention generally relates to guides for slidable shelves in metal cabinets. Alternatively, the invention may also relate to guides for drawers in metal cabinets.

Metal cabinets are some of the most versatile pieces of furniture available. Metal cabinets can be hung in work areas such as metal or woodworking shops, garages, as well as many other places. Metal cabinets can also provide storage in vehicles such as trucks and vans. In addition to the versatility provided by metal cabinets regarding the location and placement of the cabinets, metal cabinets also provide versatility in what they store. Metal cabinets have been used to store threaded rod, wire, brake line, welding rods, as well as more common items such as tools and fasteners. Metal cabinets also include slidably mounted shelves and drawers.

As can be seen in FIG. 1, a prior art spacer A is welded to a side wall B of a cabinet. A runner C receives a drawer slide (not shown). Spacer A is positioned between the runner C and the side wall B so that a front wall of a drawer can fit flush against the side wall B of the cabinet when the drawer is in a closed position.

The spacer A is typically fastened to the side wall B using spot welds D. Runner C is also fastened to spacer A by spot welds D. It is desirable to eliminate the need for a spacer in the cabinet to reduce the number of pieces required and the manufacturing costs of the cabinet. It is also desirable to eliminate the spacer so that drawers or slidable shelves can be added to a cabinet which does not already having spacers welded to the sidewalls.

SUMMARY OF THE INVENTION

In accordance with one aspect of the invention, a cabinet runner side wall extension includes a wall, a flange extending from the wall, and a tab extending from the wall. The wall includes a first side and a second side opposite the first side. The flange extends substantially normal from the first side of the wall. The tab includes a first portion extending away from the second side of the wall and a second portion spaced from and approximately parallel to the wall.

In accordance with another aspect of the invention, a method of manufacturing a cabinet runner side wall includes forming a single piece of metal such that a first wall is substantially normal to a first flange. The method further includes forming an opening through the wall to form a tab such that a portion of the tab is still attached to the wall. The method further includes bending a portion of the tab such that the portion is at least substantially parallel to the wall.

Still other aspects of the invention will become apparent to those skilled in the art upon reading and understanding the following detailed description.

BRIEF DESCRIPTION OF THE DRAWINGS

The invention may take physical form in certain parts and arrangements of parts, an embodiment of which will be described in detail in this specification and illustrated in the accompanying drawings which form a part hereof.

DETAILED DESCRIPTION OF THE EMBODIMENTS

Figure 1:
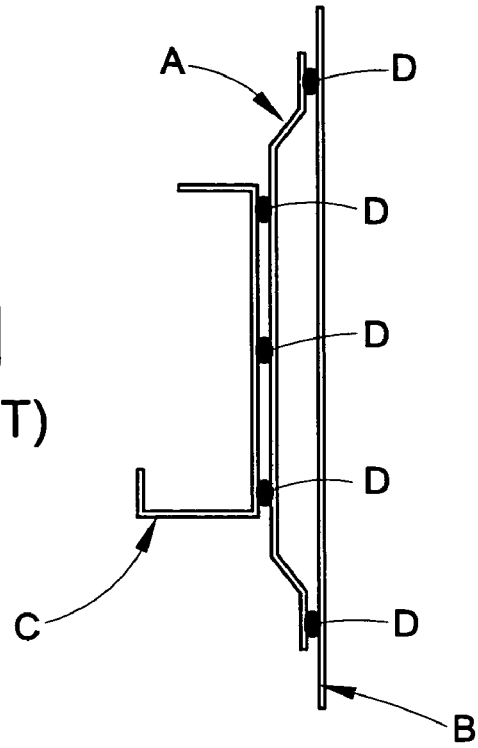
FIG. 1 (PRIOR ART)
FIG. 1 is an elevational end view of a prior art cabinet runner side wall extension.
Figure 2:
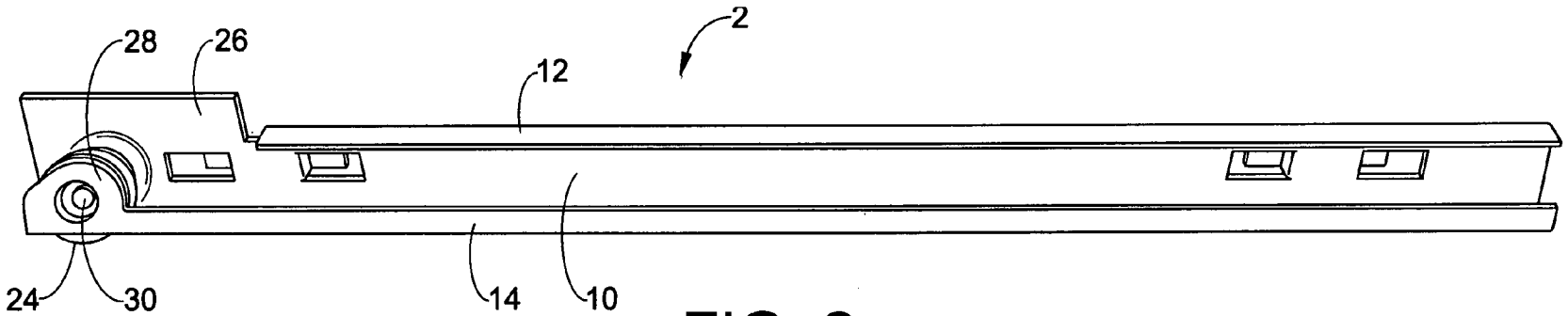
FIG. 2 is a perspective view of an inner side of a cabinet runner side wall extension in accordance with the preferred embodiment of the present invention.

Referring now to the drawings, wherein the showings are for purposes of illustrating a preferred embodiment of the invention only and not for purposes of limiting same, FIG. 2 illustrates a cabinet runner side wall extension 2 that attaches directly to the side wall of a cabinet, in accordance with the present invention. The side wall extension eliminates the need for the spacer A of FIG. 1. The cabinet runner side wall extension 2 includes a main wall 10 having a first retaining flange 12 and a second retaining flange 14. The extension 2 in the preferred embodiment is manufactured of metal such as steel that is cold formed to the desired shape. Metal is preferably used so that the extension 2 can be welded to a side wall of a metal cabinet; however, other materials can be used without departing from the scope of the present invention. When the extension is attached to a cabinet, the main wall 10 has a vertical orientation.

Figure 4:
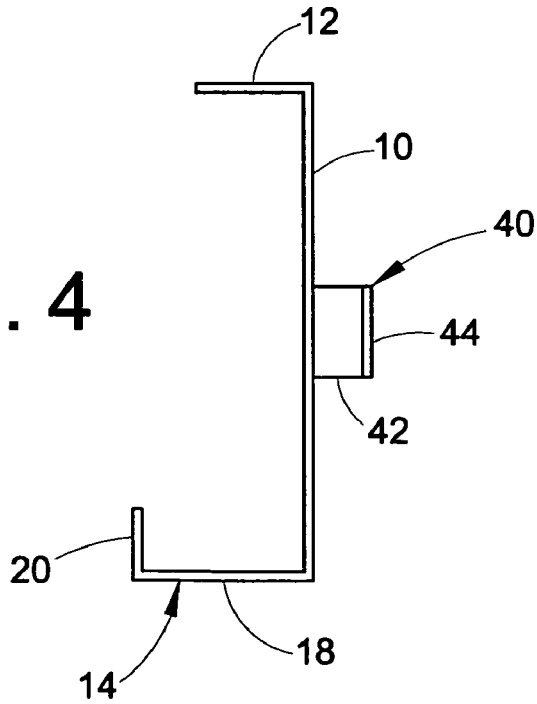

Retaining flanges 12, 14 each extend substantially perpendicular from the main wall 10. Flanges 12, 14 are substantially parallel to each other. Flange 14 has a substantially L-shaped configuration. As best seen in FIG. 4, flange 14 has a first leg 18 extending substantially perpendicular from the main wall 10 and a second leg 20 disposed in a spaced relationship from main wall 10. Second leg 20 extends from and is substantially perpendicular to first leg 18 and is parallel to the main wall.

Referring again to FIG. 2, a wheel 24 is positioned proximal a rear end 26 of the extension 2 which is positioned adjacent a rear portion of the cabinet. Wheel 24 is interposed between wall 10 and a retaining wall 28 extending from flange 14. The wheel 24 has a fastening means, such as a rivet 30, through its central axis which is attached to the retaining wall and the main wall. As can be best seen in FIG. 3, the second retaining flange 14 has an opening 32 through which a portion of the wheel 24 extends.

Figure 3:
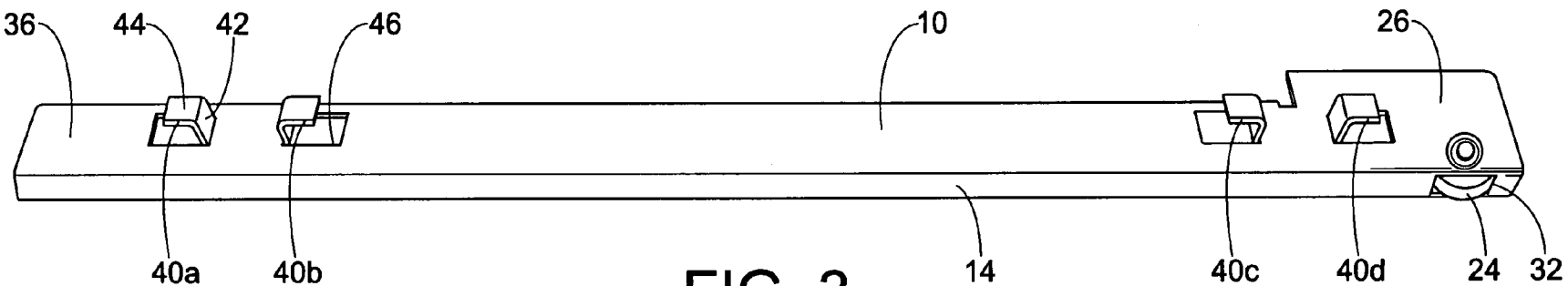
FIG. 3 is a perspective view of an outer side of the cabinet runner side wall extension of FIG. 2; and, FIG. 4 is a side elevational end view of the cabinet runner side wall extension of FIG. 2.

Referring still to FIG. 3, the extension 2 also includes a front end 36 which is positioned adjacent a front portion of the cabinet. Substantially L-shaped tabs 40 protrude from the main wall 10. In the embodiment shown, extension 2 includes four tabs 40*a*, 40*b*, 40*c*, and 40*d*. It should be recognized that other numbers of tabs may be used with the extension. Each tab 40 includes a first leg 42 that extends from and is substantially perpendicular to wall 10 and a second leg 44 that extends from and is substantially perpendicular to leg 42 and is substantially parallel to and spaced from wall 10. The first leg 42 can extend at other angles than perpendicular from the wall 10 without departing from the scope of the present invention. The tabs 40 may be punched out of the main wall 10 thus leaving an opening 46 which was previously filled with the material of the tab. Alternatively, the tabs 40 could be a separate piece of metal or plastic and welded onto the extension 2. For example, second leg 44 of the tab can be fastened to a cabinet sidewall via welding or other suitable means. The gap formed between leg 44 and wall 10 provides a space so that a slidable shelf or drawer is properly mounted and spaced from the cabinet side wall, thus eliminating the need for the spacer A of FIG. 1.

Referring again to FIG. 4, retaining flanges 12, 14 and leg 20 form a channel to receive a drawer slide. Leg 44 is spaced from wall 10 so that a drawer will fit flush with the front edge of a cabinet and thus eliminating a separate spacer.

The invention has been described with reference to a preferred embodiment. Obviously, modifications and alterations will occur to others upon the reading and understanding of this specification. It is intended to include all such modifications and alterations in so far as they are obvious to one skilled in the art of cabinetry.

The invention claimed is:

1. A cabinet runner side wall extension in combination with a cabinet, the cabinet runner side wall extension comprising:

a first wall including a first side and a second side opposite the first side;

a first flange extending at least substantially normal from the first side of the first wall, wherein the first flange includes a first portion extending from and substantially normal to the first wall and a second portion extending from said first flange first portion and spaced from and substantially parallel to the first wall;

a first tab extending from the second side of the first wall and positioned adjacent a first end of the first wall, the first tab including a first portion extending away from the second side of the first wall and a second portion extending from said first portion in a first direction and spaced from and substantially parallel to the first wall;

a second tab extending from the second side of the first wall, wherein the second tab includes a first portion extending away from the first wall and a second portion extending from said second tab first portion in a second direction opposite the first direction and spaced from and substantially parallel to the first wall, the second tab being positioned adjacent the first end of the first wall;

wherein each second portion of the first and second tabs directly attaches to a side wall of the cabinet and provide a predetermined gap between the first wall and the cabinet side wall defined by the distance that each first portion of the first and second tabs extends from the first wall; and a wheel positioned adjacent to the first end of the first wall, wherein the wheel attaches to and is interposed between the first wall and the second portion of the first flange, wherein a portion of the wheel protrudes through an opening wherein a periphery of said opening is surrounded by the first flange.

2. The cabinet runner side wall extension of claim 1, further comprising a second flange spaced from the first flange and extending substantially normal from the first side of the first wall.

3. The cabinet runner side wall extension of claim 2, wherein the first flange extends from a longitudinal edge of the first wall and the second flange extends from an opposite longitudinal edge of the first wall.

4. The cabinet runner side wall extension of claim 2, wherein the first portion of the first flange is substantially parallel to the second flange.

5. The cabinet runner side wall extension of claim 1, wherein the first tab is substantially L-shaped.

6. The cabinet runner side wall extension of claim 1, further comprising an opening in the first wall adjacent the first tab, wherein the first tab is integral to the first wall and the opening is formed as a result of the tab being formed from the first wall.

7. The cabinet runner side wall extension of claim 1, further comprising a third tab extending from the second side of the first wall, wherein the third tab includes a first portion extending away from the first wall and a second portion extending from said third tab first portion in the first direction and spaced from and substantially parallel to the first wall.

8. The cabinet runner side wall extension of claim 7, wherein the third tab is positioned adjacent a second end of the first wall.

9. The cabinet runner side wall extension of claim 1, wherein the first wall, the first flange and the first tab are together formed from a single piece of metal.

10. A cabinet runner side wall extension in combination with a cabinet, the cabinet runner side wall extension comprising:

a first wall including a first side and a second side opposite the first side;

an upper flange extending from an upper longitudinal edge of the first wall at least substantially normal from the first side of the first wall;

a lower flange extending from a lower longitudinal edge of the first wall at least substantially normal from the first side of the first wall, the lower flange including a first portion extending from and substantially normal to the first wall and a second portion extending from said lower flange first portion and spaced from and substantially parallel to the first wall;

a wheel positioned adjacent an end of the first wall, the wheel extending through an opening through the first portion of the lower flange, wherein a periphery of said opening is surrounded by the lower flange;

a first tab including a first portion extending away from the second side of the first wall and a second portion extending from said first portion in a first direction and spaced from and substantially parallel to the first wall; and a second tab adjacent to the first tab including a first portion extending away from the second side of the first wall and a second portion extending from the first portion in a second direction which is opposite the first direction and spaced from and substantially parallel to the first wall, wherein each second portion of the first and second tabs directly attaches to a side wall of the cabinet and provide a predetermined gap between the first wall and the cabinet side wall defined by the distance that each first portion of the first and second tabs extends from the first wall.

11. The cabinet runner side wall extension of claim 10, further comprising a third tab, each extending from the second side of the first wall, wherein the third tab includes a first portion extending away from the first wall and a second portion extending from the respective first portion and spaced from and substantially parallel to the first wall.

12. The cabinet runner side wall extension of claim 11, wherein the first tab and the second tab are positioned adjacent a first end of the first wall.

13. The cabinet runner side wall extension of claim 12, wherein the third tab is positioned adjacent a second end of the first wall.

14. The cabinet runner side wall extension of claim 13, further comprising a fourth tab extending from the second side of the first wall, wherein the fourth tab includes a first portion extending away from the first wall and a second portion extending from the fourth tab first portion and spaced from and substantially parallel to the first wall.

15. The cabinet runner side wall extension of claim 14, wherein the fourth tab is positioned adjacent the second end of the first wall, the third tab extending in the first direction and the fourth tab extending in the opposite second direction.

* * * * *